US007062790B2

(12) United States Patent
Rockwell

(10) Patent No.: US 7,062,790 B2
(45) Date of Patent: Jun. 20, 2006

(54) DIVING VEST

(75) Inventor: Donald Robert Rockwell, Carlsbad, CA (US)

(73) Assignee: Aqua Lung of America, Vista, CA (US)

( * ) Notice: Subject to any disclaimer, the term of this patent is extended or adjusted under 35 U.S.C. 154(b) by 105 days.

(21) Appl. No.: 10/831,598

(22) Filed: Apr. 23, 2004

(65) Prior Publication Data

US 2005/0235393 A1 Oct. 27, 2005

(51) Int. Cl.
*B63C 9/08* (2006.01)

(52) U.S. Cl. ..... 2/102; 441/108

(58) Field of Classification Search ..... 2/102, 2/69, 2.15, 2.16, 2.17, 462; 441/106, 108, 441/111, 112, 113, 114; 405/186
See application file for complete search history.

(56) References Cited

U.S. PATENT DOCUMENTS

| | | | | |
|---|---|---|---|---|
| 3,135,098 | A | | 6/1964 | Root |
| 4,752,263 | A | | 6/1988 | Pritchard et al. |
| 4,810,134 | A | | 3/1989 | Eaulconer et al. |
| 5,011,334 | A | | 4/1991 | Vorhauer |
| 5,311,833 | A | | 5/1994 | VanTassel et al. |
| 5,641,247 | A | | 6/1997 | Seligman |
| 5,860,769 | A | | 1/1999 | Seligman |
| 5,944,450 | A | | 8/1999 | Anderson |
| 5,953,750 | A | * | 9/1999 | Stella ..... 2/2.15 |
| 6,120,213 | A | * | 9/2000 | Stinton ..... 405/186 |
| 6,477,709 | B1 | | 11/2002 | Kawana |
| 6,592,417 | B1 | | 7/2003 | Kawashima et al. |
| 2002/0013107 | A1 | | 1/2002 | Angelini et al. |

* cited by examiner

*Primary Examiner*—Tejash Patel
(74) *Attorney, Agent, or Firm*—Rudolf O. Siegesmund; Gordon & Rees, LLP

(57) ABSTRACT

A new buoyancy compensator with a unique bladder design is provided. The new buoyancy compensator has a unique air bladder system that are positioned directly below the integrated weight system when considering a plane parallel to the length of a diver. The new buoyancy compensator may also have air bladder systems positioned directly above the integrated weight system when considering a plane parallel to the length of a diver. The unique buoyancy compensator containing the new air bladder system facilitates a streamlined bladder that makes movements in the water easier as the movement created between the vector for lift and the center of gravity is minimized. The new buoyancy compensator has an air bladder system that is contained within the front lobes of the jacket that makes the jacket more streamlined and makes access to gear contained on the jacket much easier. Moreover, the streamlined nature of the compensator increases the stability of the user during entry and exit from the water.

18 Claims, 4 Drawing Sheets

DIVING VEST

FIELD OF THE INVENTION

This invention relates to the field of underwater diving vests. More specifically, this invention relates to an underwater diving vest that allows for a more streamlined design and use by a user. Further, this invention relates to a diving vest that allows for an air bladder system that is positioned on a diving vest to facilitate easier use and manipulation of the vest.

BACKGROUND OF THE INVENTION

The sport of scuba diving is the result of developments and innovations that began hundreds of years ago. Scuba diving is the most extensively used system for breathing underwater by recreational, scientific, commercial and military divers throughout the world.

Scuba diving equipment typically consists of masks, fins and a compressed air cylinder. Since recreational scuba began, it was deemed necessary for divers to wear some sort of safety vest, especially for surface support. Up through the 1960s, most divers used what is commonly referred to as a "snorkeler's vest". These are much like an aviation vest, with a slender oral hose and a CO2 cartridge for emergency inflation.

With the expansion of recreation diving and the development of better vests and the concept of buoyancy control, the snorkeler's vest began to fade as the option of choice by most divers. The next incarnation of diving vest was still a vest, customarily called a "Mae West" vest. This unit had added a larger inflation hose, to be used under water, and added a crotch strap.

The introduction of the crotch strap became necessary because when a diver added air to the vest underwater it would make the vest positively buoyant. Typically, the diver would wear a weight system or belt to hold him or her down to counter the negative buoyancy so the vest and the weight system were countering each other, but there was no device to hold the diver down.

Later in diving development, a mechanical inflator was developed for use, in conjunction with the vest. The inflator allowed the air from the tank to fill the buoyancy control rather than requiring oral inflation of the vest.

The big advancement in the scuba diving vest system came with the introduction of the buoyancy control jacket. The buoyancy control jacket essentially integrated the tank backpack and vest into one unit for use by a diver. It was more comfortable and easier to wear. The crotch strap was eliminated and the jacket was an easier fit. The buoyancy control jacket also supported the tank's weight better while the diver was standing on dry land. More importantly, the jacket supported the tank's weight better underwater. The buoyancy control jacket allowed the air to travel within the vest having a bladder that extended behind the diver, which allowed the diver increased comfort in the water. When combined with the mechanical inflator, buoyancy compensation became standard which was employed by the vast majority of divers.

However, there existed several problems with the common buoyancy compensator. The buoyancy compensator was much looser than the old diving vests and there was no way to tighten it in the chest/shoulder area. Moreover, when the jacket was filled, it inflated the front of the jacket, which put considerable pressure on the diver's head between the two upper lobes of the jacket. In order to provide lift to the diver, the front chambers had to fill before the diver was lifted. The typical buoyancy control jacket would need considerable weight to produce lift and keep the diver under water. To achieve the high weight necessary, some manufacturers implemented weight-integrated jackets, allowing the diver to eliminate the belt by putting the weights into pockets or chambers in the buoyancy control unit. A problem associated with these integrated weight systems is that they do not eliminate the pressure on the head of the user when the jacket is inflated. Moreover, the weight systems did not eliminate the cumbersome feel and qualities of the jacket. The weight system tended to restrict access to gear that may be integrated into the jacket.

Recently, some manufacturers had the front air chambers removed by adding adjustable shoulder straps. The advantage to adding the adjustable shoulder straps instead of air chambers would allow for increased vision of the diver and make for a more comfortable fit. Moreover, the jackets are sleeker, more compact, and more comfortable. Today's vests and/or jackets are essentially the same as the jackets with removed chambers. Diving jackets and/or vests today have added some features that were not present in past vests, including increased lift capacity and a wider shoulder harness that offers added support to the diver. However, with all these added features comes added bulk, less sleekness and more uncomfortable fit.

Another feature which has been added to most vests and/or buoyancy compensator jackets is integrated weights. These buoyancy vests have integrated the weight systems that used to be a separate unit worn by the diver. The typical vest now has two front pockets, each holding lead weights, that slip into the vest easier even than donning a standard weight belt. The problem exists that many of these vests having the integrated weight systems, and the added features are very bulky and heavy for a user.

A further problem exists because the added weight and features that are incorporated into the jacket are very difficult for the user to access. Another problem exists wherein the air bladder that is in the front lobe portion of the jacket is either on top or beneath an integrated weight system or pocket when considering a horizontal plane passing through a diver's midsection. However, the positioning of the air bladder in this position restricts the movements of a diver in water and above water.

Yet another problem exists because the air bladder systems currently in use are not streamlined for easy access by the diver to gear he/she may have attached to the jacket. Still a further problem exists in prior art jackets because lift is much more difficult because of the positioning of the air bladder systems in these jackets.

What is needed is a jacket that has air containing portions directly above or below the integrated weight system when considering a plane parallel to the length of the diver. Further, a need exists for a jacket having an air bladder system contained within the front lobes of the jacket wherein the air in the front lobes allow for a streamlined bladder that provides for easier access to gear when it is positioned closer to the diver's body. Further, a need exists for a streamlined bladder that provides increased stability for entering and exiting the water. Further, a streamlined bladder is needed that minimizes the possibility of entanglement with nearby objects in a boat and/or in the water. Still further, a need exists for a streamlined bladder that makes movement in the water during partial inflation of the bladder easier as the moment created between the vector for lift and the center of gravity of the diver is minimized. A further need exists for a unique bladder design that adds lift making it easier to maintain various positions under and/or above the water.

SUMMARY OF THE INVENTION

The present invention provides a new buoyancy compensator with a unique bladder design. More specifically, the present invention provides a new buoyancy compensator that has air bladder portions positioned directly below the integrated weight system when considering a plane parallel to the length of a diver. Additionally, the present invention provides a new buoyancy compensator that has air bladder portions positioned directly above the integrated weight system when considering a plane parallel to the length of a diver. The present invention also provides a new buoyancy compensator that provides a streamlined bladder that makes movements in the water easier as the moment created between the vector for lift and the center of gravity is minimized.

To this end, in an embodiment of the present invention, a buoyancy compensator is provided. The buoyancy compensator has a diving unit to be worn by an individual wherein the diving unit has a front lobe. Additionally, the compensator has at least one pocket adapted for use on the unit and an integrated weight system on the diving unit. Moreover, the buoyancy compensator has an air bladder system contained within the diving unit.

In an embodiment, the integrated weight system has at least one weight removably contained within an envelope.

In an embodiment, the integrated weight system is removably detachable from the diving unit.

In an embodiment, the air bladder system is contained within the front lobe of the diving unit.

In an embodiment, the integrated weight system and the air bladder system are positioned on the front lobe of the diving unit.

In an embodiment, the air bladder system is positioned above the integrated weight system in relation to a horizontal plan passing through the individual.

In an embodiment, the air bladder system is positioned below the integrated weight system in relation to a horizontal plan passing through the individual.

In an embodiment, the air bladder system is positioned above and below the integrated weight system in relation to a horizontal plan passing through the individual.

In an embodiment, the air bladder system is positioned above and/or below the integrated weight system but not inboard or outboard of the integrated weight system when one considers the individual to be inboard of the weights.

In an embodiment, the air bladder system is contained only in the front lobe of the diving unit.

In an embodiment of the present invention, a buoyancy compensator system is provided. The buoyancy compensator has a diving unit to be worn by an individual. Said diving unit includes a back portion and a shoulder portion. The compensator has at least one front lobe of the diving unit. Additionally, the buoyancy compensator has at least one shoulder strap wherein said shoulder strap connects the at least one front lobe of the diving unit with a shoulder portion. Moreover, the unit has an integrated weight system configured to carry at least one weight wherein the weight is contained within an envelope means and an air bladder system contained on the front lobe of the diving unit.

In an embodiment, the integrated weight system has at least one weight contained therein where the weight is contained within an enveloping means on the front lobe of the diving unit.

In an embodiment, the integrated weight system is contained within the front lobe of the diving unit and wherein at least one weight is removably attachable to the diving unit.

In an embodiment, the air bladder system is contained within the front lobe of the diving unit.

In an embodiment, the air bladder system is contained within the front lobe of the diving unit wherein the air bladder system is positioned above the integrated weight system in relation to a horizontal plane passing through the individual utilizing the diving unit.

In an embodiment, the air bladder system is contained within the front lobe of the diving unit wherein the air bladder is positioned below the integrated weight system in relation to a horizontal plane passing through the individual utilizing the diving unit.

In an embodiment, the air bladder system is contained within the front lobe of the diving unit wherein the air bladder system is inboard or outboard of the weight system when the individual is considered inboard of the weights.

In an embodiment, the air bladder system is contained within the front lobe of the diving unit wherein the air is positioned above and below the integrated weight system in relation to a horizontal plane passing through the individual utilizing the diving unit.

In an embodiment, the air bladder system is contained only in the front lobe of the diving unit.

In an embodiment, the air bladder system may be partially or fully inflated wherein the air bladder system location creates a vector for lift that counters the center of gravity of an individual.

It is, therefore, an advantage of the present invention to provide a unique buoyancy compensator.

Another advantage of the present invention is to provide a unique buoyancy compensator with a unique bladder design.

Still another advantage of the present invention is to provide a unique buoyancy compensator with a unique bladder wherein the unique bladder has a streamlined design.

Yet another advantage of the present invention is to provide a unique buoyancy compensator with a unique bladder wherein the air bladder is contained within a front lobe portion of the jacket.

Still another advantage of the present invention is to provide a unique buoyancy compensator with a unique bladder design wherein the buoyancy compensator contains an integrated weight system.

Another advantage of the present invention is to provide a unique buoyancy compensator with a unique bladder design wherein the compensator combines an integrated weight system with a unique bladder system.

Yet another advantage of the present invention is to provide a unique buoyancy compensator with a unique bladder design wherein the air bladder system is contained below the position of an integrated weight system.

Sill another advantage of the present invention is to provide a unique buoyancy compensator with a unique bladder design wherein the air bladder system is contained below the position of an integrated weight system when considering a horizontal plane passing through the diver's midsection.

Another advantage of the present invention is to provide a unique buoyancy compensator with a unique bladder design wherein the air bladder system is contained above the position of an integrated weight system.

A further advantage of the present invention is to provide a unique buoyancy compensator with a unique bladder design wherein the air bladder system is contained above the position of an integrated weight system when considering a horizontal plane passing through the diver's midsection.

Yet another advantage of the present invention is to provide a unique buoyancy compensator with a unique bladder design wherein no air-containing bladder may be inboard or outboard of the weight system when one considers the diver to be inboard of the weight system.

Still another advantage of the present invention is to provide a unique buoyancy compensator with a unique bladder design wherein the air bladder system is contained within the front lobes of the buoyancy compensator.

Still another advantage of the present invention is to provide a unique buoyancy compensator with a unique bladder design wherein the air bladder system is contained within the front lobes of the buoyancy compensator which may add lift to the user of the compensator.

A further advantage of the present invention is to provide a unique buoyancy compensator with a unique bladder design wherein the air bladder system may be contained within the front lobes of the buoyancy compensator which may add lift to the user and further wherein the air bladder in the front lobes may facilitate easier maintenance of the positions under water.

Still another advantage of the present invention is to provide a unique buoyancy compensator with a unique bladder design wherein the air bladder system is contained within the front lobes of the buoyancy compensator which may add lift to the user and further wherein the air bladder system contained within the front lobes will make it easier to maintain various positions above the water surface.

Yet another advantage of the present invention is to provide a unique buoyancy compensator with a unique bladder design wherein the air bladder is placed below the position of the integrated weight system which may provide a streamlined bladder.

Still another advantage of the present invention is to provide a unique buoyancy compensator with a unique bladder design wherein the air bladder is placed above the position of the integrated weight system which may provide a streamlined bladder.

Another advantage of the present invention is to provide a unique buoyancy compensator with a unique bladder design wherein the unique bladder design facilitates easier access to gear positioned on the compensator.

A further advantage of the present invention is to provide a unique buoyancy compensator with a unique bladder design wherein the unique bladder design facilitates easier access to gear stored in the compensator wherein the gear is closer to the body.

Yet another advantage of the present invention is to provide a unique buoyancy compensator with a unique bladder design wherein the unique bladder design allows for a streamlined bladder than increases stability of a user when entering the water.

Still another advantage of the present invention is to provide a unique buoyancy compensator with a unique bladder design wherein the unique bladder design allows for a streamlined bladder that increases stability of a user when exiting the water.

Still another advantage of the present invention is to provide a unique buoyancy compensator with a unique bladder design wherein the unique bladder design allows for a streamlined bladder that increases stability of a user when exiting the water.

Still another advantage of the present invention is to provide a unique buoyancy compensator with a unique bladder design wherein the unique bladder design allows for a streamlined bladder that minimizes entanglement with nearby objects in the water.

An advantage of the present invention is to provide a unique buoyancy compensator with a unique bladder design wherein the unique bladder design allows for a streamlined bladder that minimizes entanglement with nearby objects on the boat before or after water exercises.

Yet another advantage of the present invention is to provide a unique buoyancy compensator with a unique bladder design wherein the unique bladder design makes movements in the water easier.

Still another advantage of the present invention is to a unique buoyancy compensator with a unique bladder design wherein the unique bladder design makes movements in the water easier during partial inflation.

Another advantage of the present invention is to a unique buoyancy compensator with a unique bladder design wherein the unique bladder design makes movements in the water easier during partial inflation as differences between the vector for lift and the center of gravity of the diver is minimized.

Another advantage of the present invention is to provide a unique buoyancy compensator with a unique bladder design wherein the bladder system is less bulky than prior art jackets.

Still another advantage of the present invention is to provide a unique buoyancy compensator with a unique bladder design wherein the bladder system is more streamlined and less cumbersome for a diver.

Yet another advantage of the present invention is to provide a unique buoyancy compensator with a unique bladder design wherein the bladder system facilitates better lift of a diver while in the water.

Another advantage of the present invention is to provide a unique buoyancy compensator with a unique bladder design wherein the bladder system facilitates better lift when the diver is at the surface of the water.

A further advantage of the present invention is to provide a unique buoyancy compensator with a unique bladder design wherein the bladder system is in the front lobes of the jacket which provides a balance between the diver's center of gravity and positive lift.

Yet another advantage of the present invention is to provide a unique buoyancy compensator with a unique bladder design wherein the bladder system is positioned in the front lobe of the jacket wherein the positive lift will keep a diver upright at the surface of the water.

These and other objects of the invention will become more clear when one reads the following specification, taken together with the drawings that are attached hereto. The scope of protection sought by the inventor may be gleaned from a fair reading of the Claims that conclude this specification. Additional features and advantages of the present invention are described in, and will be apparent from, the detailed description of the presently preferred embodiments and from the drawings.

DESCRIPTION OF THE PREFERRED EMBODIMENT

Figure 1:
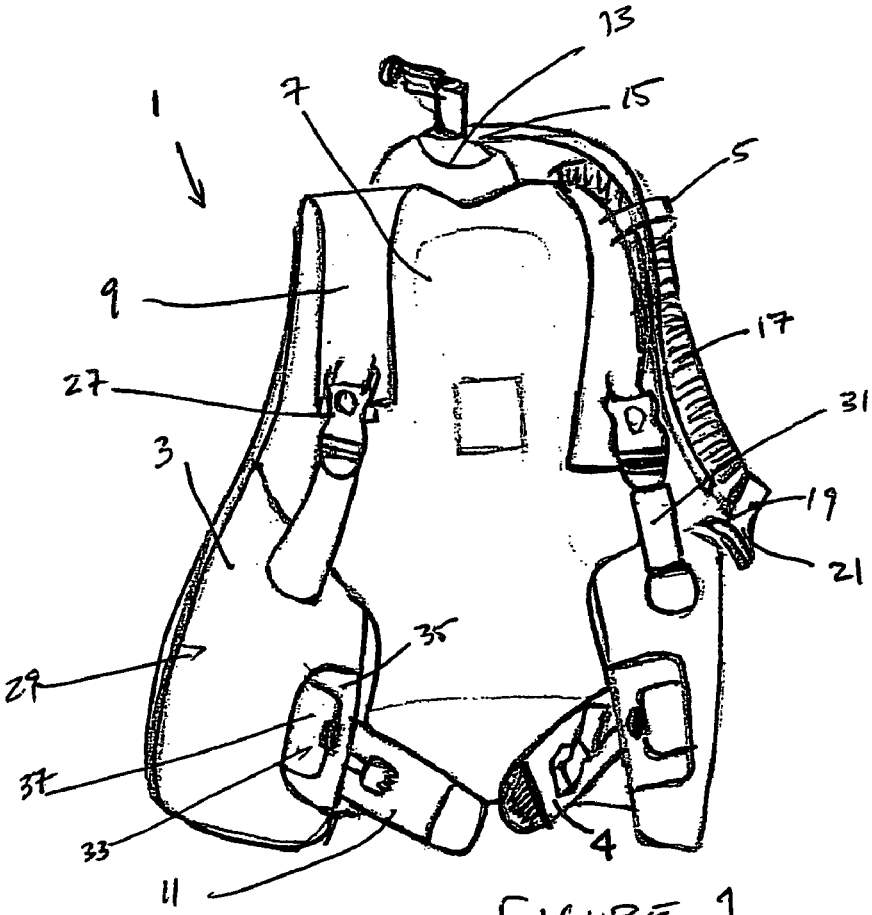
FIG. 1 is a perspective view of the diving vest in an embodiment of the present invention.

Turning now to the drawings wherein elements are identified by numbers and like elements are identified by like numbers throughout the 7 figures, the invention is depicted in FIG. 1 that shows a buoyancy compensator jacket 1. The buoyancy compensator jacket 1 may include a bladder portion wherein compensating air may be introduced. The jacket 1 may have an air tank strap 5 and a cushion pad 7. A diver may wear the jacket 1 with a shoulder strap 9 as well as a waist belt 4 having been length adjusted. The air tank 13 is provided on its top with a first stage regulator 15 from which a regulator hose 17 extends to a second stage regulator 19 from which, in turn, an inflation hose extends to a rear side of the jacket. A mouthpiece 21 is mounted on the second stage regulator 19. The shoulder strap 9 extends along the outer side, then along the inner side and again along the inner side of the rear body of the jacket and its longitudinal opposite ends are connected by a buckle means 23 (shown in FIG. 3) in a length adjustable manner. The buckle means 23 may be fastened on the air tank strap 5 to fix the air tank 13 to the jacket 1.

As illustrated in FIG. 1, the buoyancy compensator may have a shoulder strap 9, that is connected to a back portion 25 of the jacket 1. The shoulder strap 9 may be connected by a buckle system 27 to a front lobe 29 of the buoyancy compensator jacket 1. The shoulder strap 9 may be connected by a buckle system 27 to the front lobe 29 of the buoyancy compensator jacket 1. The front lobe 29 of the buoyancy compensator jacket 1 may have an opening and/or pockets (not shown) for attachments. The front lobe 29 of the buoyancy compensator jacket 1 may have an opening and/or pockets (not shown) for accessories to be attached to and/or contained within the compensator jacket 1. The shoulder strap 9 of the jacket 1 may be connected to the front lobes 29 by shoulder straps 31. The shoulder straps 31 may be integrated into the front lobes 29 and may extend outward from the front lobes 29 to the shoulder straps 9. The shoulder straps 31 may attach to the shoulder straps 9 by use of a buckle system 27. In a preferred embodiment of the invention, the connection means is a buckle 27. The connection means 27 may be any means of connecting the shoulder straps 31 to the shoulder portion 9 of the buoyancy compensator jacket 1. In an embodiment, the connection means 27 may be attached by velcro®, a d-ring, and pivot point, and/or zipper means.

Figure 2:
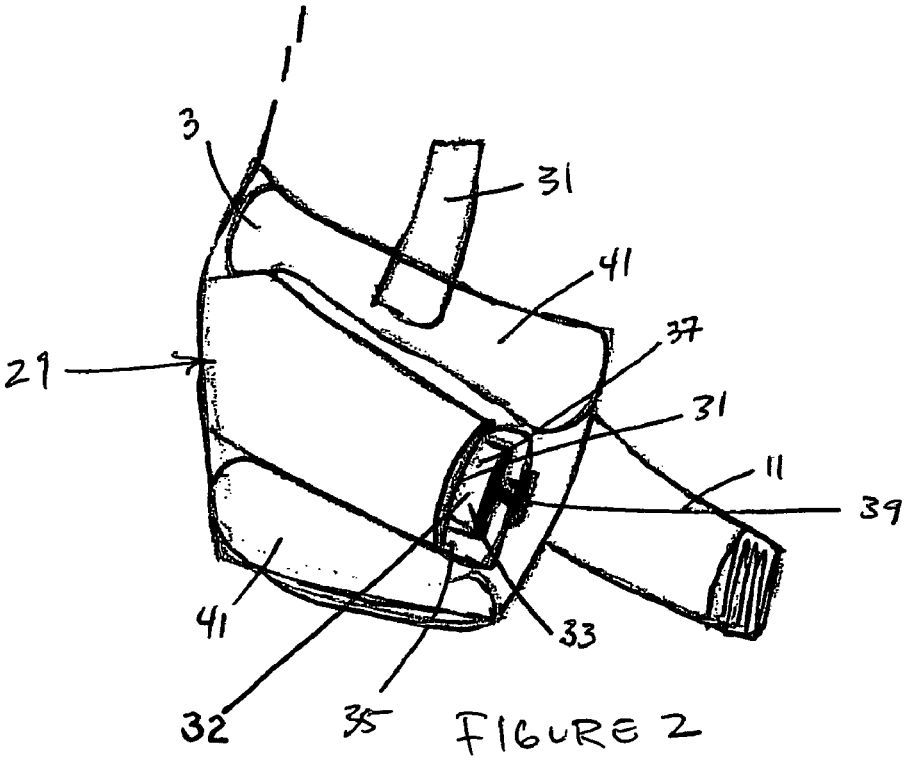
FIG. 2 is a close up view of the front lobe of the diving vest in the embodiment shown in FIG. 1.

As illustrated in FIG. 1 and FIG. 2, the front lobe 29 of the buoyancy compensator jacket 1 may have an integrated weight system 32. The Integrated weight system 32 may have an insertable weight 33 disposed within at least one side opening pocket 35 attached to the front lobe 29 of the compensator jacket 1. The side opening pocket 35 may be formed of a piece of material attached to the waist band portion 11 to define a channel in the space between the waistband portion 11 and the piece of material. At least one weight 33 may be disposed within an envelope 37, and the envelope 37 may be placed within the pocket 35 within the front lobe 29 of the compensator jacket 1. The integrated weight system 32 may also include a means for inserting, securing and removably releasing the weight system from the pocket and/or opening.

FIG. 2 illustrates the front lobe 29 of the buoyancy compensator jacket 1. The front lobe 29 may have a shoulder strap 31 attached thereto for connection to the shoulder strap 9. The front lobe 29 may also have a waist band portion 11 for connection to an opposite attaching waist band portion (not shown) from the opposing frontal lobe of the jacket (not shown). The front lobe 29 may also have an integrated weight system 32 having an envelope 37 contained therein. Weights 33 may be placed within an opening and/or pocket 35 in the front lobe 29 of the jacket 1. The envelope 37 for placement of weights 33 may also have a means 39 for inserting and removably releasing the envelope 37 from the pocket 35 on the front lobe 29 of the jacket 1.

Figure 5:
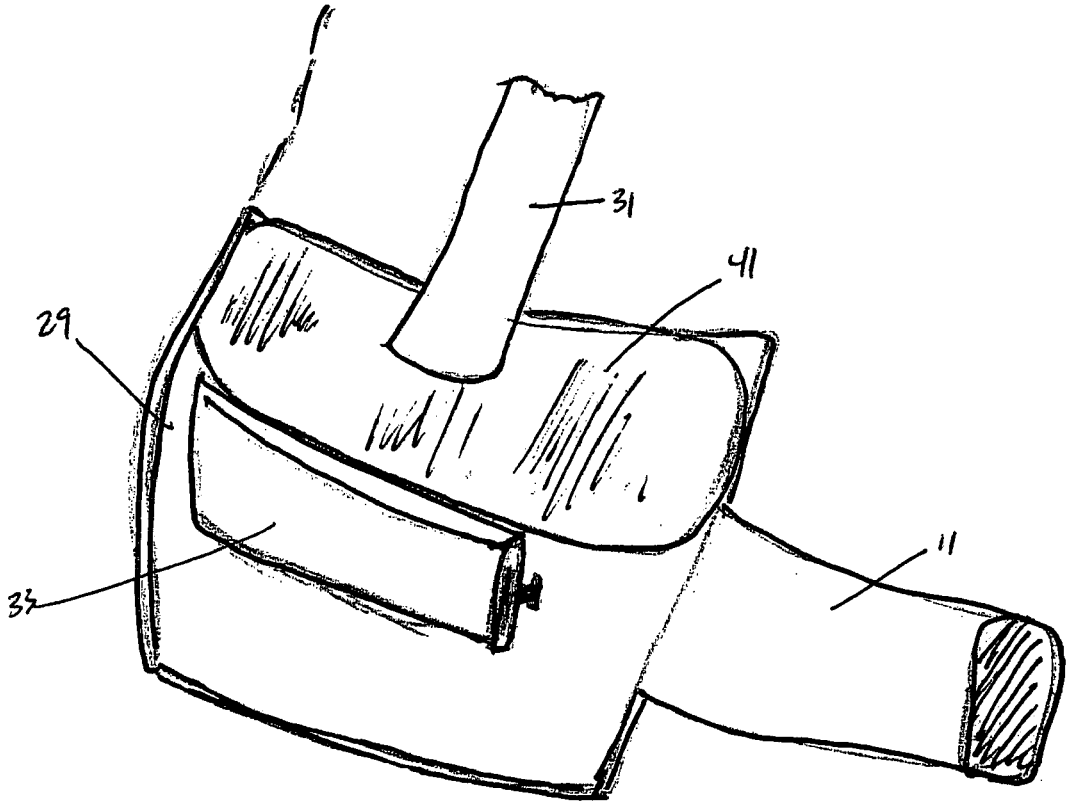
FIG. 5 is a close-up perspective view of the front lobe of the diving vest with an air bladder positioned above the weight system in an embodiment of the present invention.
Figure 6:
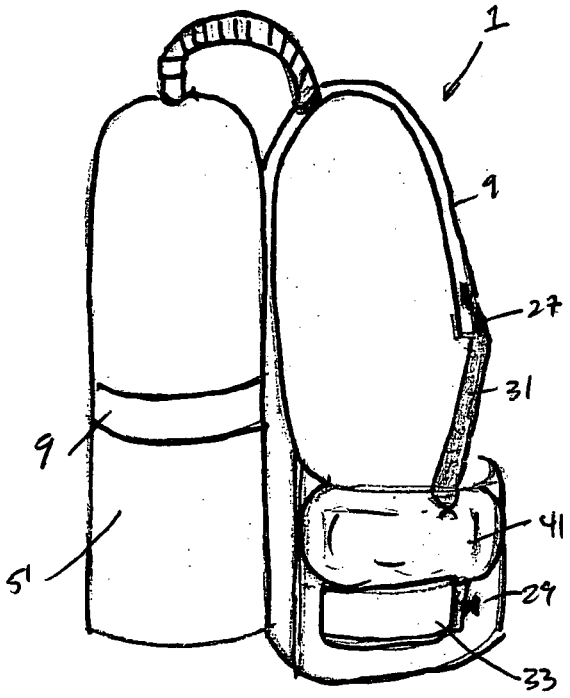
FIG. 6 is a side view of the diving vest with an air bladder positioned above the weight system in the front lobe in an embodiment of the present invention; and, FIG. 7 is a side view of the diving vest with an air bladder positioned below the weight system in the front lobe in an embodiment of the present invention.
Figure 7:
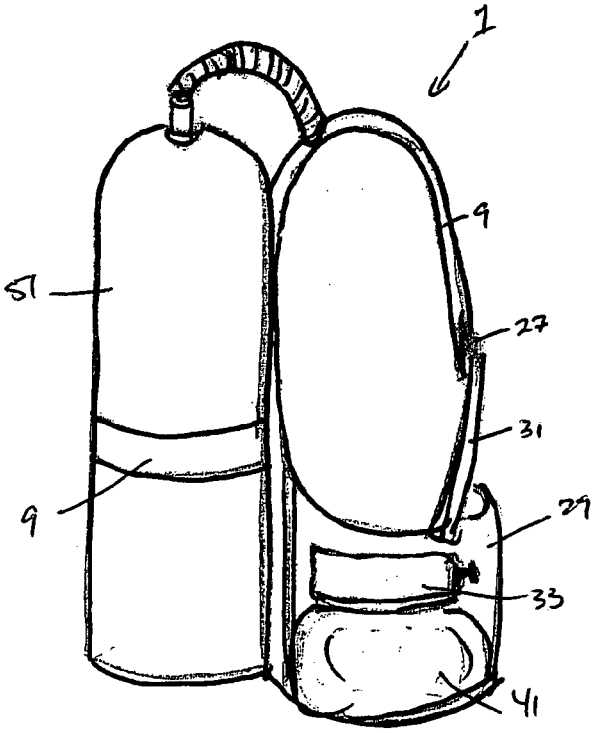

The buoyancy compensator jacket 1 may have at least one air bladder 41 that may be contained on the front lobe 29 of the jacket 1. The air bladder 41 may be on the front lobe 29 portion of the jacket 1 and may be positioned on top and/or beneath the integrated weight system 32 as illustrated in FIGS. 6 and 7. FIG. 5 illustrates the front lobe 29 of the buoyancy compensator jacket 1 wherein the air bladder 41 is positioned above the integrated weight system 32. Similarly, FIG. 6 illustrates a side view of the compensator jacket 1 wherein the air bladder 41 may be positioned within the front lobe 29 of the jacket 1 and may be located in a position above the integrated weight system 32 when considering a horizontal plane passing through the diver's (not shown) midsection. FIG. 7 illustrates a side view of the compensator jacket 1 wherein the air bladder 41 may be contained within the front lobe 29 of the jacket 1 and may be located in a position below the integrated weight system 32 when considering a horizontal plane passing through the diver's midsection.

FIG. 2 illustrates the front lobe 29 of the buoyancy compensator jacket 1 and the integrated weight system 32 contained thereon. The integrated weight system 32 may be centrally located on the front lobe 29 of the jacket 1. However, in another embodiment, the integrated weight system 32 may be positioned lower and/or higher in on the front lobe 29 of the jacket 1 in relation to the horizontal plane passing through a diver's midsection. The air bladder 41 may be positioned above the integrated weight system 32 on the front lobe 29. In another embodiment, the air bladder 41 may be positioned below (not shown) the integrated weight system 32 on the front lobe 29 of the compensator jacket 1. In yet another embodiment, the air bladder 41 may be positioned above and below the integrated weight system 32 in the front lobe 29 of the compensator jacket 1. In a preferred embodiment, the air bladder 41 would not be inboard and/or outboard of the integrated weight system when one considers the diver to be inboard of the weight system 33. The positioning of the air bladder system 41 away from the integrated weight system 32 may allow for a streamlined bladder and front lobe 29 of the jacket 1 as illustrated in FIGS. 6 and 7. Moreover, the positioning of the air bladder 41 may facilitate easier access to gear (not shown) that may be positioned on the buoyancy compensator jacket 1.

Figure 3:
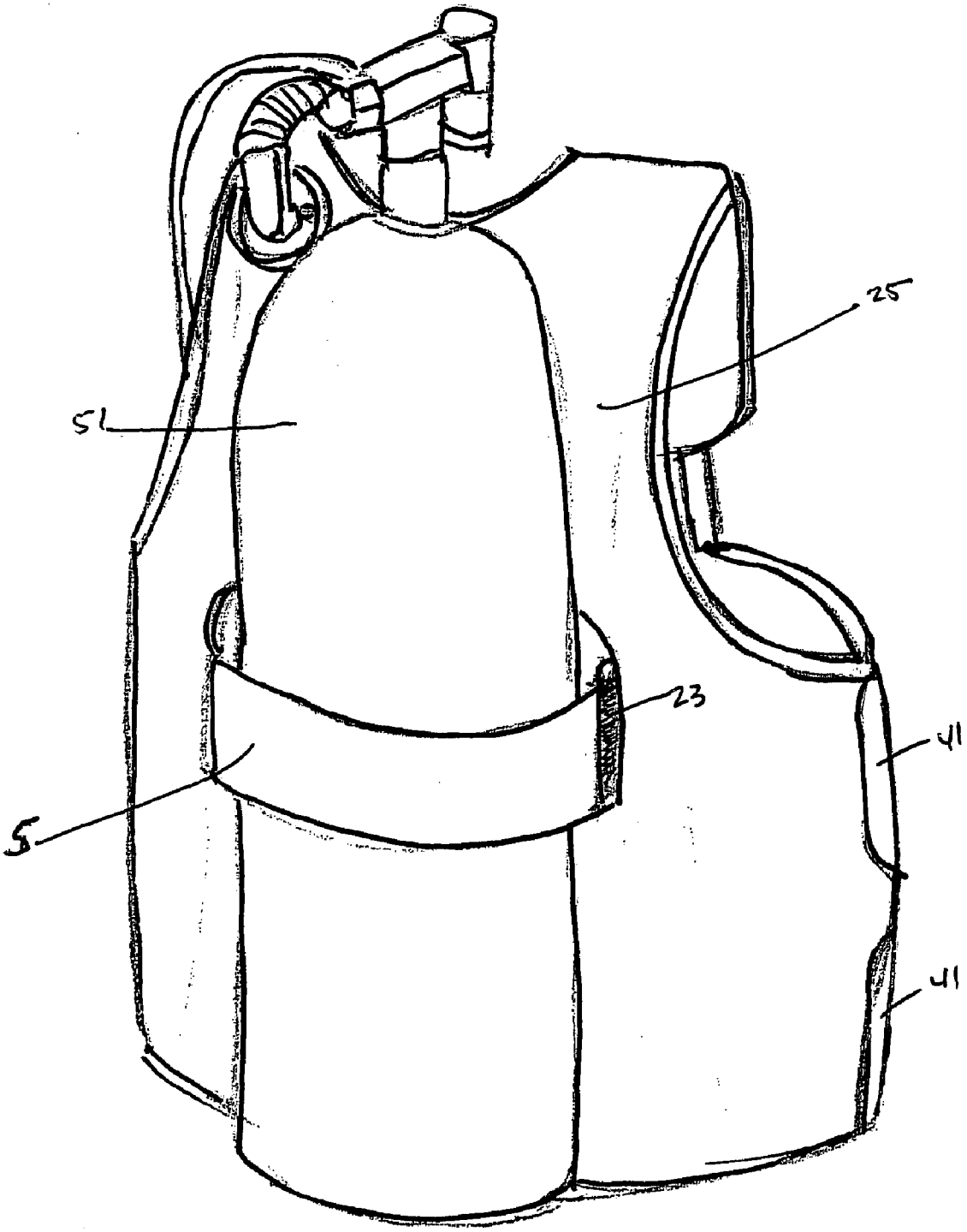
FIG. 3 is a rear perspective view of the diving vest in the embodiment shown in FIG. 1.

FIG. 3 illustrates a back view of the compensator jacket 1. As illustrated in FIG. 3, the air bladder system 41 is positioned only on the front lobe of the jacket, and no air bladder system 41 is positioned on the back of the compensator jacket 1 in relation to the diver (not shown). The position on the front lobe 29 of the jacket 1 may facilitate easier movement of a diver (not shown) in water and/or at the surface of the water when partially inflated. When partially inflated, the vector for lift and the center of gravity for the diver may be minimized. The positioning of the air bladder 41 on the front lobe 29 of the jacket 1 may also facilitate added lift for the diver (not shown) which may make it easier to maintain various positions under and above the water.

Figure 4:
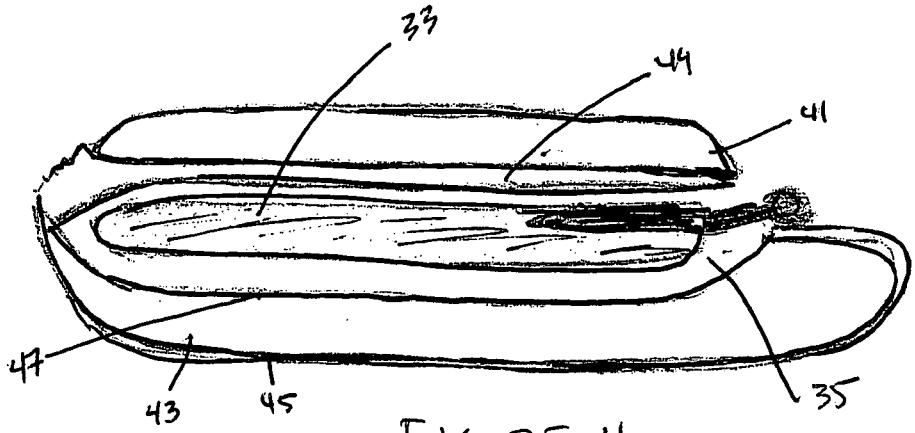
FIG. 4 is a cross-sectional view of the front lobe of the embodiment shown in FIG. 1.

FIG. 4 illustrates a cross-sectional view of the front lobe 29 of the buoyancy compensator jacket 1. The front lobe 29 of the jacket 1 may have an inner portion 43 that may contact the body of the diver (not shown). The inner portion 43 of the front lobe 29 of the jacket 1 may have first side 45 in contact with the body of the diver. Moreover, the inner side of the front lobe 29 of the jacket 1 may have a second side 47 wherein the second side 47 of the inner portion 43 of the jacket may form a portion of opening 35 that may house the integrated weight system 32. The integrated weight system 32 may be maintained by a side opening pocket 35 between the inner portion 43 of the buoyancy compensator jacket 1 and an outer portion 49 of the buoyancy compensator jacket 1. The outer portion 49 of the front lobe 29 of the jacket 1 may have a plurality of layers. The layers may be comprised of a material to contact the integrated weight system 32, and the air bladder 41. In another embodiment of the present invention, the outer portion 49 of the front lobe 29 of the jacket may be the air bladder 41. The air bladder 41 may be inflated by a user to add lift. In a preferred embodiment, the air bladder 41 is not directly above the integrated weight 33. In the preferred embodiment, the air bladder 41 may be positioned in the outer portion 49 of the jacket 1 above and/or below the location of the integrated weight system 32 when considering a horizontal plane passing through a diver's midsection.

FIG. 5 illustrates the front lobe 29 of the buoyancy compensator jacket. As illustrated, the front lobe may have a shoulder strap 31 attached thereto to connect the front lobe of the jacket to the shoulder portion of the jacket. The front lobe 29 may also have a waist portion 11 to connect a first front lobe with a second lobe (not shown). The waist portion 11 may connect to a second waist portion (not shown) for attachment around the midsection of a diver.

FIG. 5 also illustrates the integrated weight system 32 of the buoyancy compensator 1 with an air bladder 41 contained within the front lobe 29 of the jacket 1 whereby the air bladder 41 may be positioned above the position of the integrated weight system 32 of the jacket 1.

FIG. 6 and FIG. 7 illustrate the buoyancy compensator jacket 1 with attached air supply tank 51. FIG. 6 and FIG. 7 illustrate the front lobe 29 of the jacket 1 in connection with the shoulder strap 9 of the jacket 1 and the back portion 25 of the jacket 1.

FIG. 7 illustrates an air bladder 41 wherein the air bladder 41 is positioned below the integrated weight 32 in the front lobe 29 of the jacket 1.

It should be understood that various changes and modifications to the presently preferred embodiments described herein will be apparent to those skilled in the art. Such changes and modifications may be made without departing from the spirit and scope of the present invention and without diminishing its attendant advantages.

What is claimed is:

1. A buoyancy compensator jacket comprising:

(a) a diving unit to be worn by an individual wherein the diving unit has a front lobe;

(b) at least one pocket adapted for use on the unit;

(c) an integrated weight system on the diving unit; and, (d) an air bladder system contained within the diving unit wherein said air bladder system is positioned only in the front lobe of the diving unit.

2. The buoyancy compensator jacket of claim 1, further comprising: the integrated system wherein the integrated weight system has at least one weight removably contained within an envelope.

3. The buoyancy compensator jacket of claim 1, further comprising the integrated weight system wherein the integrated weight system is removably detachable from the diving unit.

4. The buoyancy compensator jacket of claim 1 wherein the air bladder system is positioned on the outside of the front lobe of the diving unit.

5. The buoyancy compensator of claim 1 wherein the integrated weight system and the air bladder system are positioned on the front lobe of the diving unit.

6. The buoyancy compensator regulator of claim 1 wherein the air bladder system is positioned above the integrated weight system in relation to the horizontal plane of an individual.

7. The buoyancy compensator of claim 1 wherein the air bladder system is positioned below the integrated weight system in relation to the horizontal plane of an individual.

8. The buoyancy compensator of claim 1 wherein air bladder system is positioned above and below the integrated weight system in relation to the horizontal plane of an individual.

9. The buoyancy compensator of claim 1 wherein the air bladder system is positioned above and/or below the integrated weight system but not inboard or outboard of the integrated weight system when one considers the individual to be inboard of the weights.

10. The buoyancy compensator of claim 1 wherein the air bladder system is contained only in the front lobe of the diving unit.

11. A buoyancy compensator system comprising:

(a) a diving unit to be worn by an individual said diving unit including a back portion and a shoulder portion;

(b) at least one front lobe of the diving unit;

(c) said diving unit having at least one shoulder strap wherein said shoulder strap connects the at least one front lobe of the diving unit with a shoulder portion;

(d) an integrated weight system configured to carry at least one weight wherein the weight is contained within an envelope means; and, (e) an air bladder system contained only in the front lobe of the diving unit.

12. The buoyancy compensator of claim 11 wherein the integrated weight system has at least one weight contained therein and further wherein the weight is contained within an enveloping means on the front lobe of the diving unit.

13. The buoyancy compensator of claim 11 wherein the integrated weight system is contained within the front lobe of the diving unit and further wherein at least one weight is removably attachable to the diving unit.

14. The buoyancy compensator of claim 11 wherein the air bladder system is contained within the front lobe of the diving unit.

15. The buoyancy compensator of claim 11 wherein the air bladder system is contained within the front lobe of the diving unit and further wherein the air bladder system is positioned above the integrated weight system in relation to the horizontal plane of an individual utilizing the diving unit.

16. The buoyancy compensator of claim 11 wherein the air bladder system is contained within the front lobe of the diving unit and further wherein the air bladder is positioned below the integrated weight system in relation to the horizontal plane of an individual utilizing the diving unit.

17. The buoyancy compensator of claim 11 wherein the air bladder system in contained within the front lobe of the diving unit and further wherein the air bladder system is inboard or outboard of the weight system when the individual is considered inboard of the weights.

18. The buoyancy compensator of claim 11 wherein the air bladder system is contained with the front lobe of the diving unit and further wherein the air bladder is positioned above and below the integrated weight system in relation to the horizontal plane of an individual utilizing the diving unit.

* * * * *